US012330748B1

(12) United States Patent
Nielsen

(10) Patent No.: US 12,330,748 B1
(45) Date of Patent: Jun. 17, 2025

(54) POWERED HYDROFOIL BOARD WITH INTEGRATED CONTROL FLAP

(71) Applicant: Simon Nielsen, Beverly Hills, CA (US)

(72) Inventor: Simon Nielsen, Beverly Hills, CA (US)

(73) Assignee: Snap Inc., Santa Monica, CA (US)

( * ) Notice: Subject to any disclaimer, the term of this patent is extended or adjusted under 35 U.S.C. 154(b) by 591 days.

(21) Appl. No.: 17/538,317

(22) Filed: Nov. 30, 2021

Related U.S. Application Data

(60) Provisional application No. 63/131,386, filed on Dec. 29, 2020.

(51) Int. Cl.
*B63B 1/24* (2020.01)
*B63B 1/28* (2006.01)

(52) U.S. Cl.
CPC ..... *B63B 1/246* (2013.01); *B63B 1/242* (2013.01); *B63B 1/28* (2013.01)

(58) Field of Classification Search
CPC ..... B63B 1/242; B63B 1/246; B63B 1/28; B63B 32/10; B63B 32/20; B63B 32/45; B63B 32/60; B63B 32/70; G05D 1/02; G05D 1/0206
USPC ..... 441/79
See application file for complete search history.

(56) References Cited

U.S. PATENT DOCUMENTS

| | | | | |
|---|---|---|---|---|
| 3,886,884 | A * | 6/1975 | Stark | B63B 1/286 114/275 |
| 5,448,963 | A * | 9/1995 | Gallington | B63B 1/283 114/274 |
| 7,047,901 | B2 * | 5/2006 | Chen | B63B 32/20 114/274 |
| 9,359,044 | B2 * | 6/2016 | Langelaan | B63H 1/16 |
| 10,358,194 | B1 * | 7/2019 | Wengreen | B63B 32/10 |
| 10,597,118 | B2 * | 3/2020 | Montague | B63B 32/60 |
| 10,994,815 | B2 * | 5/2021 | Wengreen | B63B 32/10 |

* cited by examiner

*Primary Examiner* — Daniel V Venne
(74) *Attorney, Agent, or Firm* — CM Law; Stephen J. Weed

(57) ABSTRACT

A hydrofoil board having a hydrofoil configured to be automatically controlled to stabilize the board in a level position even when incurring waves. The hydrofoil includes a pair of individually controllable flaps that control the pitch and direction of the hydrofoil board when propelled in motion. A processor uses an inertial measurement unit (IMU) to obtain orientation and acceleration information of the hydrofoil board. A global positioning system (GPS) unit is also used as an additional speed and location sensor. The processor combines IMU data with a user/rider's input, such as selected speed and direction via handheld wireless controller, and individually controls the flap motors to position the flaps, and the propulsion motor to set speed. In one example, the controller is configured to bring the hydrofoil board to a complete and stabile stop.

11 Claims, 4 Drawing Sheets

POWERED HYDROFOIL BOARD WITH INTEGRATED CONTROL FLAP

CROSS-REFERENCE TO RELATED APPLICATIONS

This application claims priority to U.S. Provisional Application Ser. No. 63/131,386 entitled POWERED HYDROFOIL BOARD WITH INTEGRATED CONTROL FLAP, filed on Dec. 29, 2020, the contents of which are incorporated fully herein by reference.

TECHNICAL FIELD

The present disclosure generally relates to powered hydrofoil boards.

BACKGROUND

Powered hydrofoil boards typically included a floatable board, a downwardly extending strut, a propulsion mechanism, and a hydrofoil.

BRIEF DESCRIPTION OF THE DRAWINGS

In the drawings, which are not necessarily drawn to scale, like numerals may describe similar components in different views. Like numerals having different letter suffixes may represent different instances of similar components. Some examples are illustrated by way of example, and not limitation, in the figures of the accompanying drawings in which.

DETAILED DESCRIPTION

This disclosure provides a hydrofoil board having a hydrofoil configured to be automatically controlled to stabilize the board in a level position even when incurring waves. The hydrofoil includes a pair of individually controllable flaps that control the pitch and direction of the hydrofoil board when propelled in motion. A processor uses an inertial measurement unit (IMU) to obtain orientation and acceleration information of the hydrofoil board. A global positioning system (GPS) unit is also used as an additional speed and location sensor. The processor combines IMU data with a user/rider's input, such as selected speed and direction via handheld wireless controller, and individually controls the flap motors to position the flaps, and the propulsion motor to set speed. In one example, the controller is configured to bring the hydrofoil board to a complete and stabile stop.

Additional objects, advantages and novel features of the examples will be set forth in part in the description which follows, and in part will become apparent to those skilled in the art upon examination of the following and the accompanying drawings or may be learned by production or operation of the examples. The objects and advantages of the present subject matter may be realized and attained by means of the methodologies, instrumentalities and combinations particularly pointed out in the appended claims.

The description that follows includes systems, methods, techniques, instruction sequences, and computing machine program products illustrative of examples of the disclosure. In the following description, for the purposes of explanation, numerous specific details are set forth in order to provide an understanding of various examples of the disclosed subject matter. It will be evident, however, to those skilled in the art, that examples of the disclosed subject matter may be practiced without these specific details. In general, well-known instruction instances, protocols, structures, and techniques are not necessarily shown in detail.

The examples illustrated herein are described in sufficient detail to enable those skilled in the art to practice the teachings disclosed. Other examples may be used and derived therefrom, such that structural and logical substitutions and changes may be made without departing from the scope of this disclosure. The Detailed Description, therefore, is not to be taken in a limiting sense, and the scope of various examples is defined only by the appended claims, along with the full range of equivalents to which such claims are entitled.

Reference now is made in detail to the examples illustrated in the accompanying drawings and discussed below.

Figure 1:
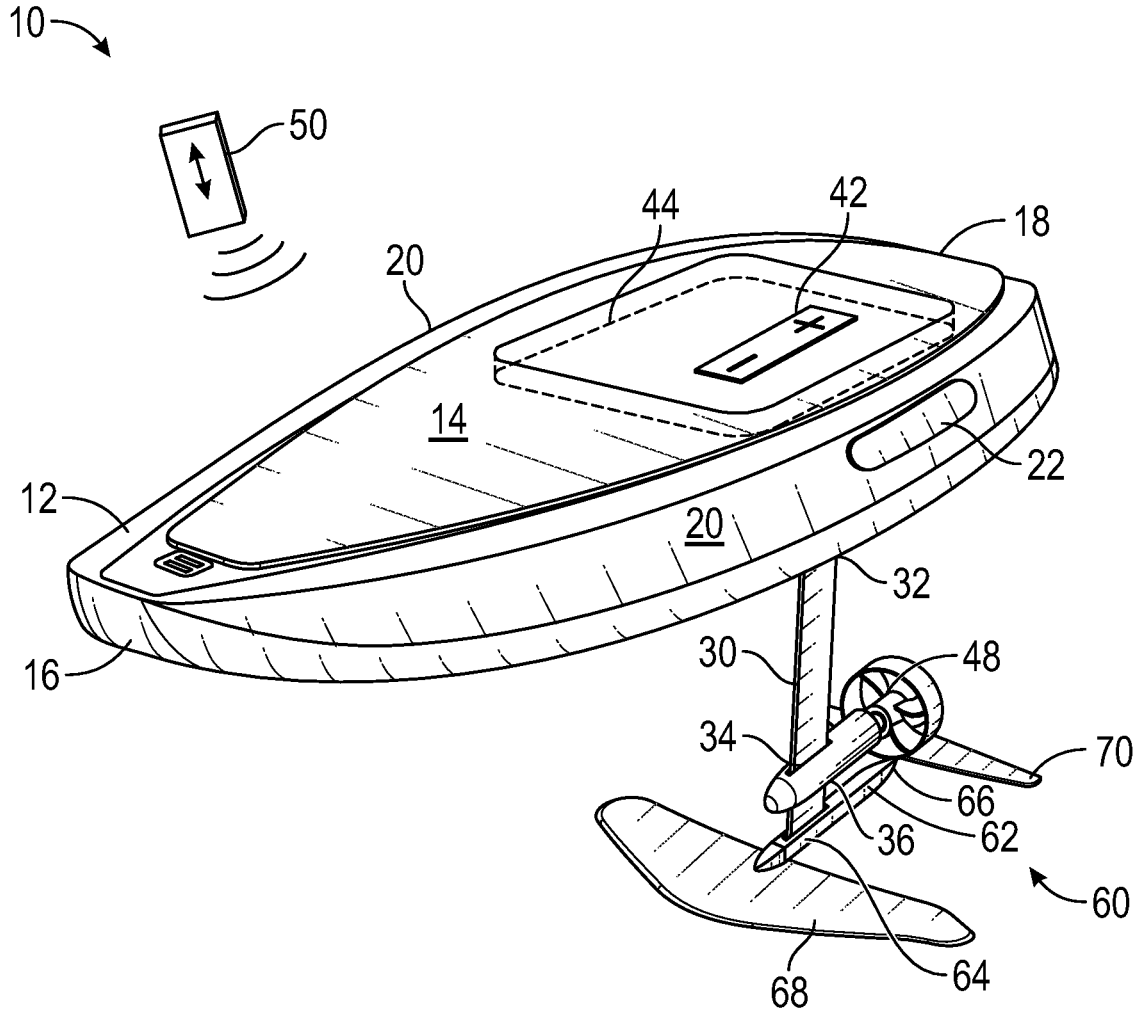
FIG. 1 illustrates a perspective view of a hydrofoil board.

Referring to FIG. 1 there is shown a top perspective view of a hydrofoil board 10 including an elongated floatable board 12. Board 12 is generally planar and has a top surface 14 configured to support a user who rides the board. A front portion is tapered to a front end 16, and a rear portion is tapered to a rear end 18. A pair of board sides 20 are tapered outwardly and may include a respective handle 22.

Also shown in FIG. 1 is a strut 30 securely coupled to a bottom surface 24 of the board 12 at a rear central portion of the board 12. The strut extends from an upper end 32 to a lower end 34. A body 36 is securely coupled to the strut 30 proximate the lower end 34 and extends longitudinally rearward to a body end 38. A propulsion system 40 is coupled to the body end 18 and is configured to selectively propel the hydrofoil board 10 forwardly above the water. In an example, the propulsion system 40 is electrically powered by a battery 42 positioned in a storage compartment 44 located at the board rear end 18. In one example the propulsion system 40 includes an electric motor 46 (FIG. 4) positioned in body 36 and is drivingly coupled to a propeller 48. The propulsion system 40 is selectively controlled by the user to control speed of the hydrofoil board 10 using a wireless controller 50 having buttons or a touchpad.

The hydrofoil board 10 also includes a stabilizer system generally shown at 60 and including a stabilizer bar 62 coupled to the strut lower end 34. The stabilizer bar 62 extends longitudinally and generally parallel to the body 36 and has a front end 64 and a rear end 66. The stabilizer system 60 is configured to provide ride stability when the hydrofoil board 12 is propelled above the water. The stabilizer system 60 also includes a hydrofoil 68 coupled to the bar front end 64 and that is formed as a wing positioned horizontally, and generally parallel to the board 12. A tail 70 is coupled to the bar rear end 66 and is also formed as a wing that is smaller than the hydrofoil 68. Both the hydrofoil 68 and the tail 70 are designed similar to an airplane wing and which has a smooth leading edge and is tapered rearwardly to reduce drag in the water as they pass through the water. Hydrofoil boards consisting of the hydrofoil 68 and tail 70 are controlled directly by the rider shifting his or her weight to change the angle of the hydrofoil 68. This technique requires constant attention and input from the rider and is especially challenging in waves.

Figure 2:
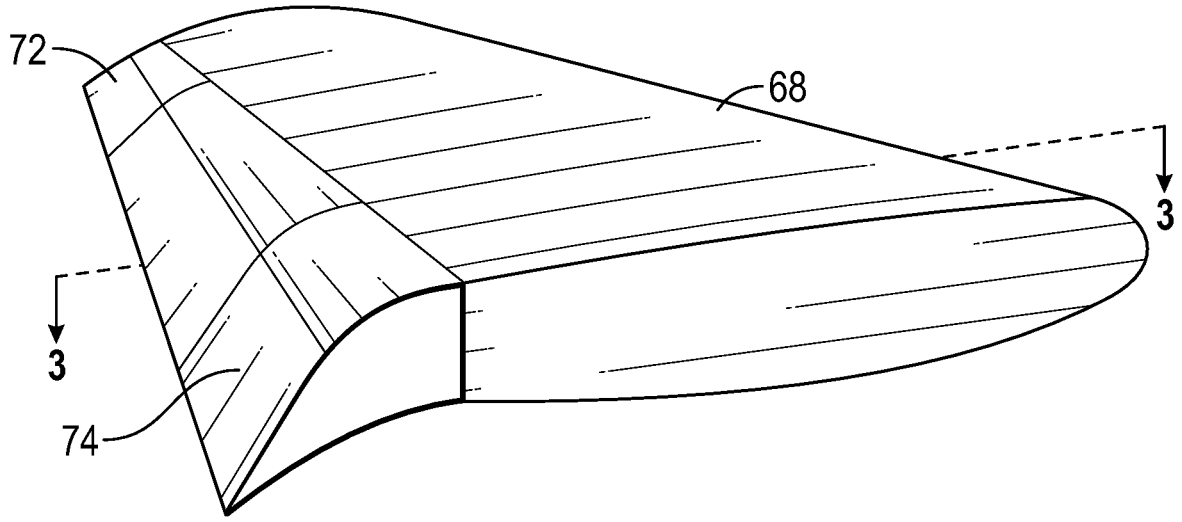
FIG. 2 illustrates a perspective view of a hydrofoil including individually controllable flaps.

Referring to FIG. 2, there is shown a perspective view of the hydrofoil 68 having a left flap 72 and a right flap 74 configured to be selectively controlled by an electronic processor 100 (FIG. 4) to automatically stabilize, and steer, the hydrofoil board 10, such as in wavy or winding conditions. The flaps 72 and 74 also reduce the strain on a user when trying to stabilize and control the hydrofoil board 10, either in smooth or wavy conditions. In one example, the flaps 72 and 74 are configured to help bring the hydrofoil board 10 to a stop, which is generally a difficult task. The flaps 72 and 72 are similar to ailerons of an airplane, and they are configured to selectively provide lift to control pitch of the hydrofoil board 10 when positioned together in the same direction, as well as to steer the hydrofoil board 10 when one flap is positioned in one direction, or when both flaps are positioned in opposite directions. In an example, the flaps 72 and 74 can both be positioned by processor 100 upward or downward to control pitch and automatically bring the hydrofoil board 10 to a controlled stop. To turn the hydrofoil board 10 left, the left flap 72 can be moved upward, and the right flap moved downward. In another example, the flaps 72 and 74 can be coupled to the tail 70 in a similar manner to control pitch and steering. In another example, flaps can be provided on both the hydrofoil 68 and the tail 70.

Figure 3:
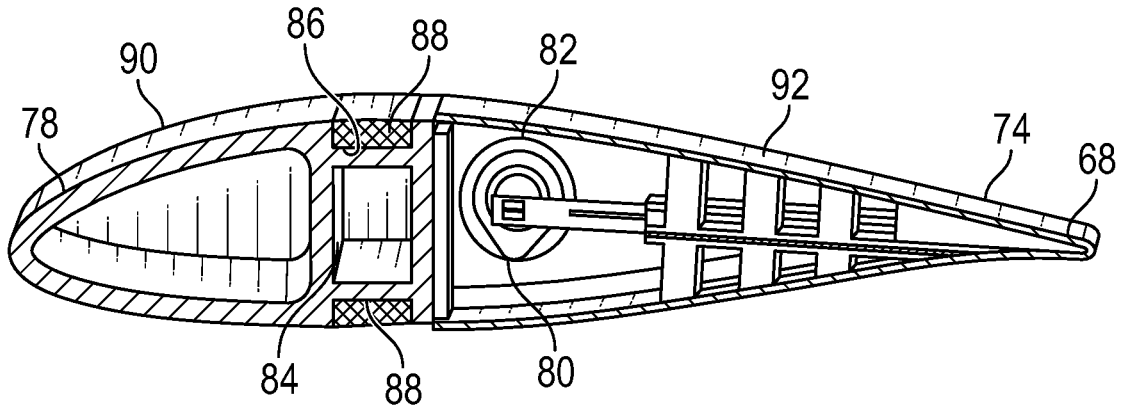
FIG. 3 illustrates a cross sectional view of the hydrofoil taken along line 3-3 in FIG. 2.

As shown in FIG. 3, there is shown a cross sectional view of the hydrofoil 68 and one flap, shown as flap 74 taken along line 3-3 in FIG. 2. The hydrofoil 68 is seen to have a tapered leading edge 78 and extending rearwardly to the flap 74. A hinge 80 is configured to allow the flap 74 to articulate with respect to the leading edge 76 of the hydrofoil 68, and a respective motor 82 (FIG. 4) is configured to articulate the flap 74 as a function of controller 76. The leading edge 76 includes a brace member 84 having a laterally extending slot 86 filled with a material 88, such as a carbon fiber material, positioned between an upper surface 90 of the leading edge 76 and an upper surface 92 of the flap 74 to provide a smooth and continuous surface that prevents drag. The material 88 forms an interface comprising a smooth and planar surface between the lead edge 76 and the respective flap.

Figure 4:
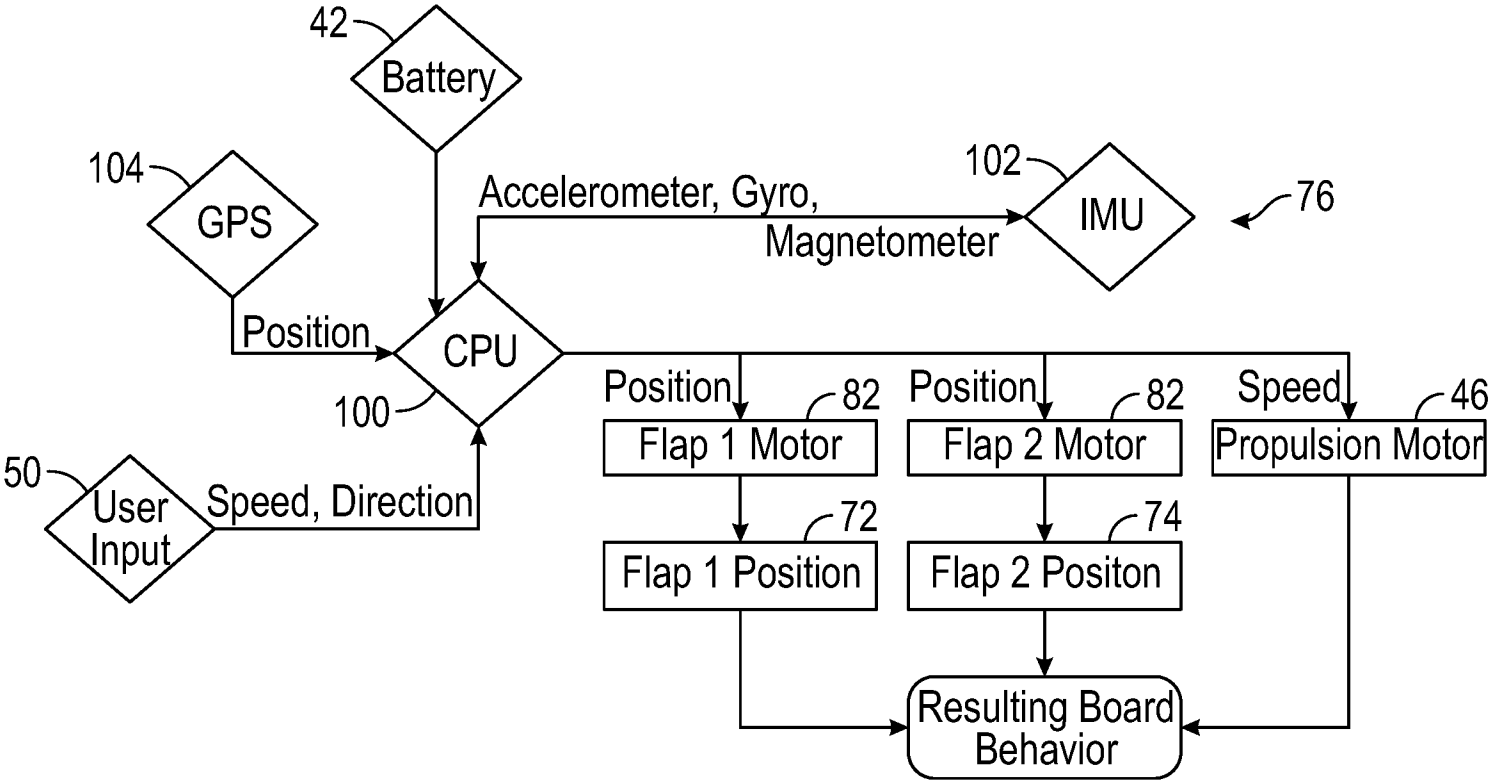
FIG. 4 illustrates a control system for controlling the hydrofoil board.

Referring to FIG. 4, there is shown the control system 76 of the hydrofoil board 10. The electrical processor 100 has on chip memory including code instructions for controlling the flaps 72 and 74 to automatically stabilize and control the position of the hydrofoil board 10 while propelled above the water. The processor 100 includes an inertial measurement unit (IMU) 102 and a global positioning system (GPS) unit 104. The processor 100 uses the IMU 102 data to automatically control the hydrofoil board 10 to remain level when in motion, unless turning, regardless of the rider's weight distribution. The processor 100 uses the IMU 102 data to control the hydrofoil board 10 to work even without a rider, referred to as a drone hydrofoil board. The processor 100 controls are complimentary to the received user controls, and in one example the processor 100 controls supersede the user provided controls via wireless controller 50.

The IMU 102 is the main sensing unit that conveys orientation and acceleration information to the processor 100. The GPS unit 104 is also used as an additional speed and location sensor. The processor 100 combines the IMU 102 data with the user/rider's input, such as speed and direction via handheld wireless controller 50, and individually controls the flap motor(s) 82 to position flaps 72 and 74, and propulsion motor 46 to set speed accordingly and ensure that the hydrofoil board 10 behaves as intended, such as level forward movement and turning. The processor 100 controls the hydrofoil board 10 to automatically react to even small disturbances from waves. The processor 100 also uses the IMU 102 to automatically bring the hydrofoil board 10 to a smooth and level stop when instructed, which is one of the hardest things to master.

In an example, the processor 100 continuously monitors the IMU 102 data to determine if the hydrofoil board 10 is level when propelled through the water. If the processor 100 determines, for example, that the hydrofoil board 10 is leaning downward to the left, the processor 100 controls the respective motor 82 to position the left flap 72 downward to create lift on the left side and bring the hydrofoil board 10 back to level. The processor 100 may also, or alternatively, control the respective motor 82 to position the right flap 74 upward to create a downward force. The processor 100 uses a feedback control loop with the IMU 102 to continuously monitor and adjust the position of the hydrofoil board 10 using flaps 72 and 74 during use. Likewise, if the processor 100 determines from the IMU 102 data the hydrofoil board 10 is leaning downward to the right, the processor 100 positions the right flap 74 downward to create lift, and may also, or alternatively position the left flap 72 upward to create a downward force. If the hydrofoil board 10 is determined by processor 100 to be pitched upwardly, the processor 100 controls both motors 82 to position both flaps 72 and 74 downward to each create lift. Likewise, if the hydrofoil board 10 is determined by processor 100 to be pitched downwardly, the processor 100 uses both motors 82 to position both flaps 72 and 74 upward to each create a downward force. The power of the propulsion motor 46 remains constant.

In an example, when the user uses the handheld controller 50 to select an automatic stop of the hydrofoil board 10, the processor 100 controls both motors 82 to position both flaps 72 and 74 downward to each create lift, while reducing the power of the propulsion motor 46. The processor may also individually control the flaps 72 and 74 to adjust for any lateral tilt during the slowdown. The processor 100 monitors the IMU 102 data and dynamically responds to the data to keep the hydrofoil board at a slight upward pitch during the slowdown.

Figure 5:
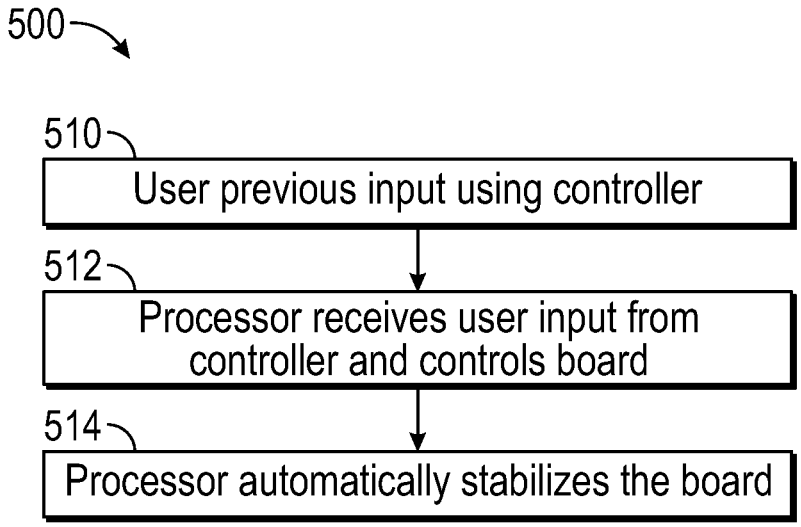
FIG. 5 illustrates a method of the controller operating the hydrofoil board.

Referring to FIG. 5, there is shown a stabilizer algorithm 500 comprising computer readable instructions executable by processor 100 and configured to control the hydrofoil board 10. The user of the hydrofoil board 10 powers it on, such as by controlling a switch, and positions oneself upon the tip surface 14 of floatable board 12 in the water.

At block 510, the user provides user input to processor 100 using wireless controller 50. The user selects the speed, such as by pressing an up/down button or portion of a touchpad, as well as a direction such as by pressing a left/right button or touchpad on the wireless controller 50.

At block 512, the processor 100 receives the user's instructions from wireless controller 50 via a wireless link. The processor 110 responsively controls the propulsion motor 46 to establish the selected speed. The processor 110 also responsively controls the flaps 72 and 74 to establish the selected direction of the hydrofoil board 10.

At block 514, the processor 100 receives IMU data from IMU 102 and automatically stabilizes the board 12 to be level during forward movement, even when the hydrofoil board 10 encounters small disturbances from waves, and when the user encounters wind that may cause the user to tilt or lose balance. The processor 100 automatically controls and adjusts the speed of the hydrofoil board 10 by controlling the amount of power delivered from battery 42 to propulsion motor 46, and automatically controls and adjusts the position of each flap 72 and 74 to automatically stabilize the board to be level. The controller 100 also automatically controls the speed and pitch of the board 12 when the user selects the stop feature using wireless controller 50, such as by pressing a stop button or touchpad. The controller controllable slows the propulsion motor 46 down, and also simultaneously controls each of the flaps 72 and 74 to keep the board 12 stable as the board 12 comes to a complete stop.

The terms and expressions used herein are understood to have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," "includes," "including," or any other variation thereof, are intended to cover a non-exclusive inclusion, such that a process, method, article, or apparatus that comprises or includes a list of elements or steps does not include only those elements or steps but may include other elements or steps not expressly listed or inherent to such process, method, article, or apparatus. An element preceded by "a" or "an" does not, without further constraints, preclude the existence of additional identical elements in the process, method, article, or apparatus that comprises the element.

The term "coupled" as used herein refers to any logical, optical, physical, or electrical connection, link, or the like by which signals or light produced or supplied by one system element are imparted to another coupled element. Unless described otherwise, coupled elements or devices are not necessarily directly connected to one another and may be separated by intermediate components, elements or communication media that may modify, manipulate, or carry the light or signals.

In addition, in the foregoing Detailed Description, it can be seen that various features are grouped together in various examples for the purpose of streamlining the disclosure. This method of disclosure is not to be interpreted as reflecting an intention that the claimed examples require more features than are expressly recited in each claim. Rather, as the following claims reflect, the subject matter to be protected lies in less than all features of any single disclosed example. Thus, the following claims are hereby incorporated into the Detailed Description, with each claim standing on its own as a separately claimed subject matter.

What is claimed is:

1. A hydrofoil board, comprising:

a floatable board having a top surface configured to support a user;

a strut having a first end coupled to the floatable board and extending to a second end;

a propulsion system coupled to the strut and configured to propel the floatable board in a direction;

a hydrofoil coupled to the strut and configured to stabilize the floatable board when in motion;

an inertial measurement unit (IMU);

a controller; and two flaps coupled to the hydrofoil and configured to be controlled by the controller in combination with the IMU to automatically stabilize the floatable board when in motion, wherein the controller is configured to control the flaps to automatically bring the floatable board to a controlled stop when the user selects a stop feature of a wireless controller.

2. The hydrofoil board as specified in claim 1, wherein the controller is configured to automatically position the floatable board in a level position when in motion.

3. The hydrofoil board as specified in claim 1, wherein the hydrofoil has a hydrofoil top surface and the flap has a flap top surface, wherein there is a smooth continuous surface between the hydrofoil top surface and the flap top surface.

4. The hydrofoil board as specified in claim 1, comprising an interface between the flap and the hydrofoil comprising a smooth continuous surface.

5. The hydrofoil board as specified in claim 1, further comprising a wireless controller configured to control the flap.

6. A method of operating a hydrofoil board including a floatable board having a top surface configured to support a user, a strut having a first end coupled to the floatable board and extending to a second end, a propulsion system coupled to the strut and configured to propel the floatable board in a direction, a hydrofoil coupled to the strut and configured to stabilize the floatable board when in motion, an inertial measurement unit (IMU), a controller, and two flaps coupled to the hydrofoil and configured to be controlled by the controller in combination with the IMU to stabilize the floatable board when in motion, comprising:

the controller receiving instructions from a wireless controller to control a speed and direction of the floatable board;

the controller in combination with the IMU controlling the flaps to automatically stabilize the floatable board when in motion; and the controller controlling the flaps to automatically bring the floatable board to a controlled stop when the user selects a stop feature of the wireless controller.

7. The method as specified in claim 6, wherein the controller automatically positions the floatable board in a level position when in motion.

8. The method as specified in claim 6, wherein the hydrofoil has a hydrofoil top surface and the flap has a flap top surface, wherein there is a smooth continuous surface between the hydrofoil top surface and the flap top surface.

9. The method as specified in claim 6, further comprising a wireless controller controlling the flap.

10. A non-transitory computer readable medium having computer readable code that when executed by a controller of a hydrofoil board including a floatable board having a top surface configured to support a user, a strut having a first end coupled to the floatable board and extending to a second end, a propulsion system coupled to the strut and configured to propel the floatable board in a direction, a hydrofoil coupled to the strut and configured to stabilize the floatable board when in motion, an inertial measurement unit (IMU), and two flaps coupled to the hydrofoil and configured to be controlled by the controller in combination with the IMU to stabilize the floatable board when in motion, is operable to:

receive instructions from a wireless controller to control a speed and direction of the floatable board;

automatically control the flaps to stabilize the floatable board when in motion; and control the flaps to automatically bring the floatable board to a controlled stop when the user selects a stop feature of the wireless controller.

11. The non-transitory computer readable medium as specified in claim 10 further including code that is operable to automatically position the floatable board in a level position when in motion.

* * * * *